United States Patent [19]

Knoos

[11] 4,366,767

[45] Jan. 4, 1983

[54] STEERING CONTROL SYSTEM FOR THE STEERING OF A BOAT

[76] Inventor: Stellan P. Knoos, 27919 Alvarez Dr., Rancho Palos Verdes, Calif. 90274

[21] Appl. No.: 154,467

[22] Filed: May 29, 1980

Related U.S. Application Data

[63] Continuation-in-part of Ser. No. 115,735, Jan. 28, 1980, abandoned, which is a continuation-in-part of Ser. No. 959,326, Nov. 9, 1978, abandoned.

[51] Int. Cl.[3] ..... B63H 25/00

[52] U.S. Cl. ..... 114/144 R; 114/44 C; 114/146; 440/53; 440/63

[58] Field of Search ..... 74/480 B, 501 R, 502, 74/503; 114/144 R, 144 C, 144 A, 146, 162, 170–172, 169; 440/53, 57, 62, 63

[56] References Cited

U.S. PATENT DOCUMENTS

| | | | |
|---|---|---|---|
| 2,543,553 | 2/1951 | McAllister | 440/63 |
| 3,263,640 | 8/1966 | Bennett | 114/144 R |
| 3,903,828 | 9/1975 | Green | 114/144 C |
| 4,188,904 | 2/1980 | Childress | 114/144 R |

*Primary Examiner*—Trygve M. Blix
*Assistant Examiner*—D. W. Keen
*Attorney, Agent, or Firm*—Edward A. Sokolski

[57] ABSTRACT

A support arm is pivotally supported on the side of a boat for movement from a horizontal to an alternate stowed side position, this arm in its horizontal position extending transversely relative to the longitudinal axis of the boat across the steering device which may comprise a tiller or wheel in the close proximity thereto. Supported on the arm for movement along the longitudinal axis thereof is a coupler member having drive cable connected thereto, the drive cable being wound about suitable blocks so as to enable positioning of the coupler along the axis of the support arm in response to movement of the cable. The coupler member has a plurality of apertures spaced longitudinally therealong which enables the selective connection of the coupler member at any one of its apertures to a mating attachment member on the tiller. Thus, the coupler is driven laterally in either direction in response to movement of the cable, thereby actuating the steering control accordingly. The cable may be driven in response to a self-steering system, such as a self-steering wind vane system or an autopilot, to control the course of the boat. When the steering control system is not in use, it can readily be disconnected from the steering control and pivotally moved to a side position where it is stowed.

4 Claims, 4 Drawing Figures

STEERING CONTROL SYSTEM FOR THE STEERING OF A BOAT

This application is a continuation-in-part of my application Ser. No. 115,375, filed Jan. 28, 1980, now abandoned which in turn is a continuation-in-part of my application Ser. No. 959,326, filed Nov. 9, 1978, now abandoned.

This invention relates to a control system for controlling the steering device (tiller or wheel) of a boat such as a sailboat, and more particularly to such a system which responds to the actuation of a control cable.

The self-steering of the tiller or wheel of a boat is commonly employed in wind vane control systems, such as described in the aforementioned co-pending application of which the present application is a continuation-in-part. Systems of this type are also described in *Self-Steering for Sailboats* by Gerard Dijkstra, published by Sail Books Inc., Boston, Mass., in 1979. Such self-steering control may also be used in systems employing compass-controlled autopilots.

Particularly in the case of a wind vane control system, there are situations where it is necessary to rapidly disconnect the control system from the tiller or wheel, such as in a sudden collision avoidance or other emergency situations where complete manual control of the tiller is needed. In most systems of the prior art, it is difficult to effect a rapid disconnection of the tiller steering control system without affecting the control cable tension, particularly in an emergency situation, and thereafter being able to rapidly reconnect the steering control system into use again. Further, in effecting such a disconnection, it is safer and highly desirable to be able to rapidly place the control system out of the way of the tiller and out of the cockpit in a stowed position, without slackening or stretching the control lines, and to obtain a clear cockpit area with no obstructing control cables.

The steering control system of the present invention is an improvement over the prior art in that it enables the convenient rapid disconnection (and reconnection) of the steering control apparatus from the tiller. In the system of the present invention, means are also provided to place the steering control mechanism in a stowed position for manual steering, out of the way of the tiller and out of the cockpit working area. The system of the present invention, while capable of rapid connection and disconnection from the tiller and while maintaining proper control cable tension, nevertheless affords low-friction, sensitive and accurate control of the tiller in response to movement of the control cabel and is capable of accurately holding the tiller or wheel in its controlled position.

It is therefore an object of this invention to provide an improved steering control system for controlling the tiller or wheel of a boat in response to a cable actuation.

It is a further object of this invention to provide an improved steering control system for the tiller of a boat which can be rapidly and easily disconnected from the tiller and placed in a stowed condition when not in use.

It is a further object of this invention to facilitate the disconnection of the self-steering control for a boat tiller, in manual steering and emergency situations.

Other objects of this invention will become apparent as the description proceeds in connection with the accompanying drawings of which:

Briefly described, the system of my invention employs an arm member which is mounted for pivotal movement, e.g. from a first preferred vertical "stowed side position" to a second horizontal operating position in which it extends transversely in a direction substantially normal to the longitudinal axis of the boat across the tiller or wheel and in contact therewith. Mounted on the arm member for longitudinal movement relative thereto is a connector member which may be in the form of a push rod or a coupler plate having a series of spaced apertures therealong. Means including a series of blocks are provided to couple the control cable for the system to the connector member so as to enable lateral positioning of the connector member in response to actuations of the cable. The control cable is actuated in either direction in response to a mechanical control signal from a control device such as a wind vane self-steering apparatus or an autopilot system. The connector member is connected to the tiller at a selected one of the apertures thereof by means of suitable connection means such as a connector pin which enables quick release of the connector member from the tiller. Thus, the arm member can be rapidly disconnected from the tiller and pivotally moved to a side position without slackening of the control lines where it is placed in a stowed condition should the need arise, yet during self-steering, accurate control of the tiller in response to cable actuation is provided.

Figure 1:
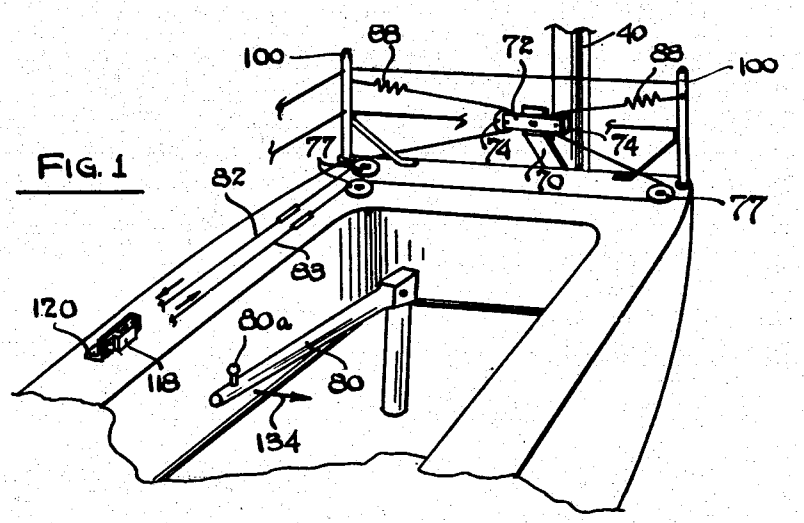
FIG. 1 is a perspective view illustrating a boat tiller and steering control cable system which may be employed with a first embodiment of the invention.
Figure 2:
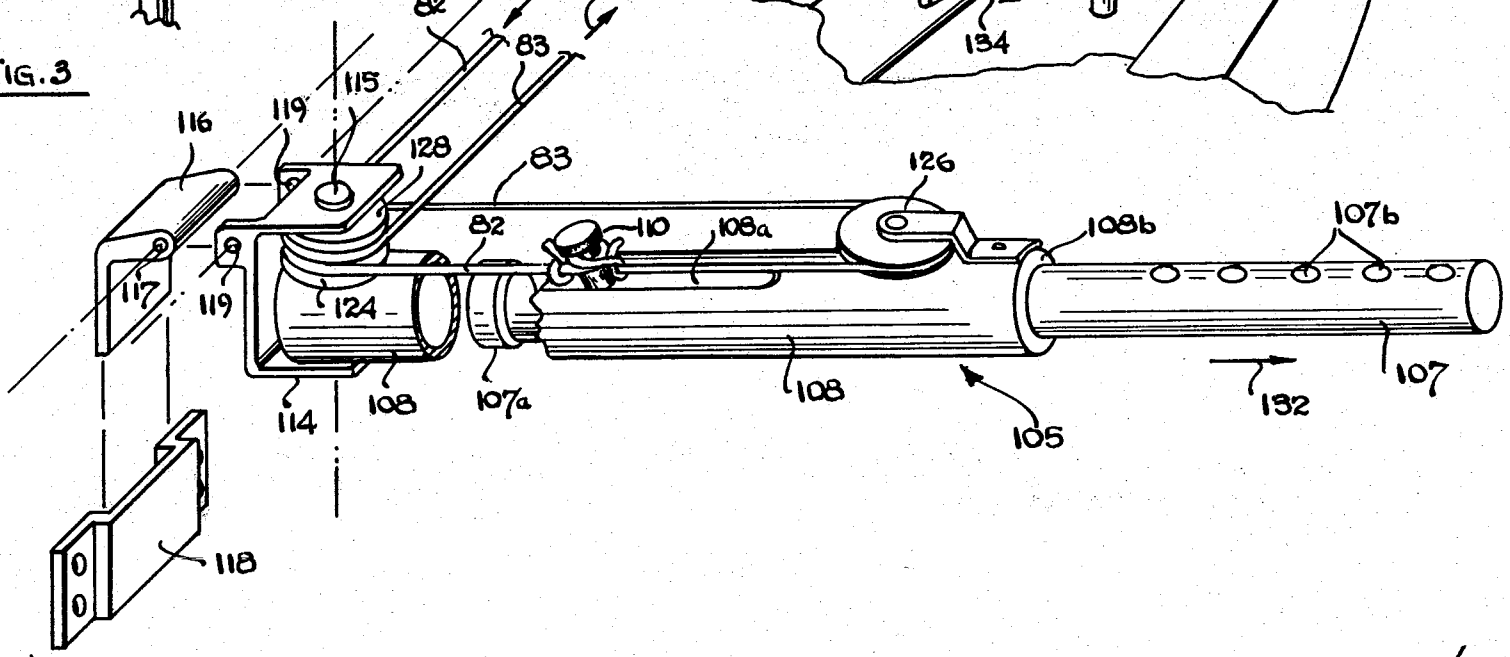
FIG. 2 is a perspective view of the first embodiment of the invention.
Figure 3:
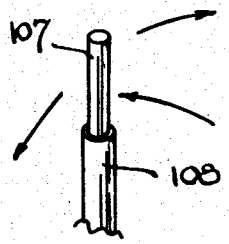
FIG. 3 is a schematic view illustrating the position of the first embodiment when in its stowed vertical condition.

Referring now to FIGS. 1–3, a first embodiment of the steering control system of the invention is illustrated. In these figures, FIG. 2 is an enlarged exploded view of a push rod mechanism which connects to the boat tiller 80 and is actuated by means of lines 82 and 83 which run around the blocks 74 of the block plate 72. Bracket 70 drives block plate 72 laterally in response to a steering control input such as may be provided by a self-steering wind vane system as described in my co-pending patent application Ser. No. 115,375, filed Jan. 28, 1980, of which the present application is a continuation-in-part. Lines 82 and 83 are resiliently tensioned by means of springs 88 which are attached to stanchions 100. Lines 82 and 83 are run around and along blocks 77 as shown. The push rod mechanism 105 comprises a push rod 107 which is slidably supported in tubular member 108 which is shown broken away for convenience of illustration. Tubular member 108 has a slot **108*a* formed therein in which pin member 110 rides. Pin member 110 is fixedly attached to push rod 107 for slidable movement in the slot. Push rod 107 has a bushing 107*a* on one end thereof, and another similar bushing thereon (not shown), these bushings being of a low friction material such as Delrin and fitted within tubular member 108. Tubular member 108 is pivotally supported by means of pivot pin 115 for rotation about an axis essentially perpendicular to the lines 82 and 83 on U-bracket 114 which in turn is pivotally supported (for rotation about an axis 117 essentially parallel and adjacent to the lines 82 and 83) on L-bracket 116 by means of a pivot pin (not shown) which goes through apertures 117 and 119. The two rotational axes through 117 and 115 permit univeral joint motion for the push rod mechanism. L-bracket 116 is removably fitted within support bracket 118** and firmly retained therein by suitable means such as a hard rubber wedge member (not shown).

As can be seen in FIG. 1, support bracket 118 is fixedly attached to L-plate 120 which in turn is fixedly attached to the yacht. Push rod 107 has a plurality of apertures **107*b* formed therein, the tiller having a spherical end rod 80*a* thereon which is fitted through a selected one of apertures 107*b*. The plurality of apertures 107*b*** thus provides means for trimming the helm to the steering control mechanism as may be necessary.

Line 82 winds one-quarter turn (or one and one-quarter turns, two and one-quarter turns, etc.) around the lower block 124 with a center line coaxial with pin 115, and is fixedly attached to push rod attachment pin 110 from where it proceeds around block 126 and finally three-quarter turns (or one and three-quarter turns, two and three-quarter turns, three and three-quarter turns, etc.) around upper block 128 coaxial with and equal in diameter to block 124 from which it exits as line 83.

The control system operates as follows: Let us assume that line 83 is drawn in the direction indicated by arrow 130. This will cause push rod 107 to be drawn in the direction indicated by arrow 132 which in turn will cause tiller 80 to be driven in the direction indicated by arrow 134. When line 82 is drawn, it should be apparent that the reverse operation occurs, thus providing for the desired control of the tiller in response to pendulous motion of the oar. It is to be noted that in view of the fact that tubular member 108 is pivotally supported on U-bracket 114 and U-bracket 114 is pivotally supported on L-bracket 116, the push rod, when disconnected from tiller 80, can be rotated about two mutually perpendicular axes, i.e., the axis of the pivotal mounting between U-bracket 114 and L-bracket 116, and a pivotal mounting between tubular member 108 and U-bracket 114; while maintaining the exact desired control cable length and tension. Thus, it is possible to rapidly and easily disconnect the push rod from the tiller and raise it upwardly, sidewise, or combinations of both, to any desired side position to clear the cockpit as schematically illustrated in FIG. 3 for stowage, should completely manual steering be desired, or should the self-steering components not be mounted for operation.

Figure 4:
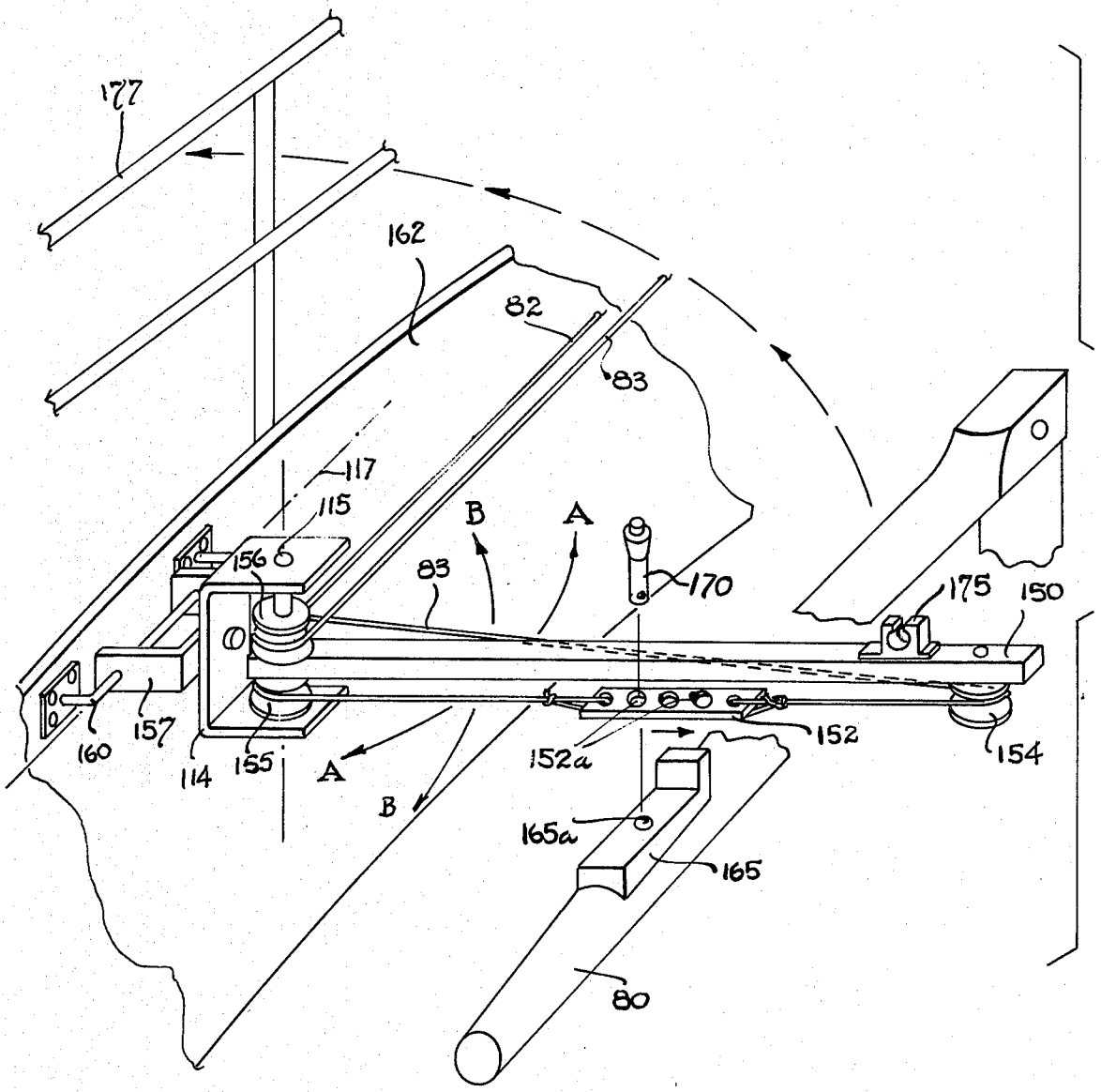
FIG. 4 is a perspective view of a second embodiment of the invention.

Referring now to FIG. 4, a second embodiment of the invention is illustrated. This second embodiment is somewhat simpler in its implementation than the first and of more economical construction. Rather than employing a push rod mechanism, in its stead an arm member 150 which supports a connector plate 152 for lateral motion relative thereto in response to control lines 82 and 83 are employed. Block members 154 and 155 are rotatably supported on the opposite ends of the bottom surface of arm 150 while block member 156 is rotatably supported on the top surface of one end of the arm, directly opposite block 155 which has a diameter equal to that of block 156. Line 82 runs a quarter turn around block member 155 and is attached at its end to one end of connector plate 152, while line 83 is wound three quarters of a turn around block 156 from where it runs under arm 150 and a half turn around block 154 and is finally attached at its end to the end of connector plate 152 opposite to that to which line 82 is attached. Arm 150 is pivotally supported on U-bracket 114 by means of pivot pin 115. U-bracket 114 is fixedly attached to a second U-bracket 157 which in turn is pivotally supported for motion about axis 117 on support rod 160, this rod being fixedly attached to the side 162 of the boat. Thus, as for the previous embodiment, the push rod mechanism is supported for motion about two mutually perpendicular axes. Plate 152 has a plurality of apertures **152*a* formed therethrough. Fixedly attached to tiller 180 is a rider member 165 having a hole 165*a* formed therein. Plate 152 is connected to rider 165 by means of a quick release pin 170 which fits through a selected one of apertures 152*a* and seats in hole 165*a*. A plurality of apertures 152*a* through plate 152 and hole 165*a* in rider 165 enable the trimming of the connection between the plate and the rider as may be necessary. A clip member 175 is fixedly attached to the top surface of arm 150 and matingly engages the pulpit 177 of the boat when arm 150 is disengaged from the tiller and pivotally raised upwardly on rod 160 to a preferred vertical stowed side position clear of the tiller and cockpit of the boat. Other stowed side positions are possible as well. The operation of the tiller control system is essentially the same as that described in connection with the first embodiment with actuation of lines 82 and 83 in one direction of the other transversely moving plate 152 and tiller 80** along with it, to effect steering of the boat.

While the invention has been described and illustrated in detail, it is to be clearly understood that this is intended by way of illustration and example only and is not to be taken by way of limitation, the spirit and scope of this invention being limited only by the terms of the following claims.

I claim:

1. A control system for controlling the steering of the steering device of a boat in response to movement of control cable means comprising arm member means, connector member means mounted on said arm member means for longitudinal movement relative thereto, quick release connector means for releasably connecting the connector member means to the steering device, said connector member means comprising a connector plate having at least one aperture formed therethrough, means having at least one hole formed therein on said steering device, said quick release connector means comprising a pin which fits through the aperture of the connector plate and seats in the hole, means for coupling the control cable means to the connector member means such that movement of the control cable means effects longitudinal movement of the connector member means and a corresponding movement of the steering device, and means for supporting the arm member means on said boat for pivotal movement between an operating position and a stowed side position, the length and tension of the control cable means being unaffected with movement between said two positions, said control cable means comprising a pair of cables which move reciprocally and the means for coupling the cables to the connector plate comprises first and second equal-diameter blocks rotatably supported on said arm member means near one end thereof and on opposite sides thereof, and a third block rotatably supported on said arm member means near the other end thereof on the same side of said arm member means as said second block, one of said cables running on said second block and being attached to one end of said connector plate, the other of said cables running on said first and third blocks and being attached to the other end of the connector plate.

2. A control system for controlling the steering of the steering device of a boat in response to movement of control cable means comprising tubular arm member means, connector member means comprising a push rod slidably mounted in said tubular arm member means for longitudinal movement relative thereto, quick release connector means for releasably connecting the connector member means to the steering device, means for coupling the control cable means to the push rod such that movement of the control cable means effects longitudinal movement of the push rod and a corresponding movement of the steering device, and means for supporting the arm member means on said boat for pivotal movement between an operating position and a stowed side position, the length and tension of the control cable means being unaffected with movement between said two positions, said cable means comprising a pair of cables, said means for coupling the cables to the push rod comprising a first block rotatably mounted on the arm member means near one end thereof and a second block rotatably mounted on the arm member means near the opposite end thereof, one of said cables being wound around the first block and connected to the push rod, the other of the cables being wound around the first and second blocks and connected to the push rod.

3. A control system for controlling the steering of the steering device of a boat in response to movement of control cable means comprising arm member means, connector member means mounted on said arm member means for longitudinal movement relative thereto, quick release connector means for releasably connecting the connector member means to the steering device, means for coupling the control cable means to the connector means such that movement of the control cable means effects longitudinal movement of the connector member means and a corresponding movement of the steering device, means for supporting the arm member means on said boat for pivotal movement between an operating position and a stowed side position, the length and tension of the control cable means being unaffected with movement between said two positions, said supporting means comprising a support member mounted on one side of the boat, bracket means attached to the arm member means, and means for pivotally connecting the bracket means to the support member, said boat having a pulpit, and clip means attached to the arm member means for pivotally connecting the bracket means to the support member.

4. A control system for controlling the steering of the steering device of a boat in response to movement of control cable means comprising arm member means, connector member means mounted on said arm member means for longitudinal movement relative thereto, quick release connector means for releasably connecting the connector member means to the steering device, means for coupling the control cable means to the connector member means such that movement of the control cable means effects longitudinal movement of the connector member means and a corresponding movement of the steering device, and means for supporting the arm member means on said boat for pivotal movement between an operating position and a stowed side position, the length and tension of the control cable means being unaffected with movement between said two positions, said control cable means comprising a pair of cables which move reciprocally and the means for coupling the cables to the connector member means comprises first and second equal-diameter blocks rotatably supported on said arm member means near one end thereof and on opposite sides thereof, and a third block rotatably supported on said arm member means near the other end thereof on the same side of said arm member means as said second block, one of said cables running on said second block and being attached to one end of said connector member means, the other of said cables running on said first and third blocks and being attached to the other end of the connector member means.

* * * * *